US011319797B2

(12) United States Patent
Morse et al.

(10) Patent No.: US 11,319,797 B2
(45) Date of Patent: May 3, 2022

(54) BEACON HOUSING LID WITH BUILT-IN PRESSURE SENSOR

(71) Applicant: The Charles Machine Works, Inc., Perry, OK (US)

(72) Inventors: Larry G. Morse, Perry, OK (US); Mark R. Marston, Perry, OK (US)

(73) Assignee: The Charles Machine Works, Inc., Perry, OK (US)

( * ) Notice: Subject to any disclaimer, the term of this patent is extended or adjusted under 35 U.S.C. 154(b) by 0 days.

(21) Appl. No.: 16/877,756

(22) Filed: May 19, 2020

(65) Prior Publication Data

US 2020/0370417 A1 Nov. 26, 2020

Related U.S. Application Data

(60) Provisional application No. 62/852,058, filed on May 23, 2019.

(51) Int. Cl.

| | |
|---|---|
| ***E21B 47/01*** | (2012.01) |
| ***E21B 7/04*** | (2006.01) |
| ***E21B 47/06*** | (2012.01) |
| ***E21B 47/13*** | (2012.01) |

(52) U.S. Cl.

CPC ..... *E21B 47/06* (2013.01); *E21B 7/046* (2013.01); *E21B 47/01* (2013.01); *E21B 47/13* (2020.05)

(58) Field of Classification Search

CPC ..... E21B 47/06; E21B 47/13; E21B 47/01; E21B 7/046; E21B 47/0232

See application file for complete search history.

(56) References Cited

U.S. PATENT DOCUMENTS

| | | | | |
|---|---|---|---|---|
| 5,174,033 | A | 12/1992 | Rider | |
| 5,419,405 | A * | 5/1995 | Patton | E21B 7/04 175/27 |
| 5,794,719 | A | 8/1998 | Holloway | |
| 7,251,567 | B2 | 7/2007 | Nickel et al. | |
| 7,624,816 | B2 | 12/2009 | Cole et al. | |
| 8,662,201 | B1 | 3/2014 | Wright, Jr. et al. | |
| 8,955,586 | B1 | 2/2015 | Randa et al. | |
| 9,995,132 | B2 | 6/2018 | Gard et al. | |
| 2005/0194184 | A1* | 9/2005 | Gleitman | E21B 49/003 175/45 |
| 2006/0065395 | A1* | 3/2006 | Snell | E21B 41/0078 166/255.2 |
| 2007/0039756 | A1 | 2/2007 | Wright et al. | |

(Continued)

*Primary Examiner* — Brad Harcourt

(74) *Attorney, Agent, or Firm* — Tomlinson McKinstry, P.C.

(57) ABSTRACT

A lid for use with a downhole tool configured to house a beacon. The lid has an exterior and interior surface. A board is attached to the interior surface of the lid and electronic hardware is positioned between the board and the interior surface of the lid. The electronic hardware includes a pressure sensor. The pressure sensor is installed within the lid so that it is communicable with the exterior surface of the lid. When the downhole tool is positioned within an underground borehole, the pressure sensor measures the fluid pressure of any fluid surrounding the downhole tool. Measurements taken by the pressure sensor are transmitted to the beacon housed within the downhole tool. The beacon subsequently transmits such measurements to a tracker located at the ground surface.

22 Claims, 13 Drawing Sheets

(56) References Cited

U.S. PATENT DOCUMENTS

| | | | | |
|---|---|---|---|---|
| 2012/0235686 | A1 | 9/2012 | Wentworth | |
| 2014/0262513 | A1* | 9/2014 | Chau | E21B 47/024 175/40 |
| 2014/0305709 | A1 | 10/2014 | Slaughter, Jr. et al. | |
| 2018/0299575 | A1 | 10/2018 | Cole | |
| 2019/0369283 | A1* | 12/2019 | Hanson | G01V 3/12 |

* cited by examiner

BEACON HOUSING LID WITH BUILT-IN PRESSURE SENSOR

SUMMARY

The present invention is directed to a downhole tool. The downhole tool comprises a beacon configured to generate a magnetic dipole field and an elongate housing having an exterior surface within which a cavity is formed. The cavity receives the beacon and has an open mouth joined to the exterior of the housing. The downhole tool further comprises a lid configured to close the mouth of the cavity. The lid comprises an inner layer disposable in a face-to-face relationship to the beacon, an outer layer opposed to the inner layer and including an exterior surface, and an intermediate layer situated between the inner and outer layers and comprising electronic hardware.

The present invention is also directed to an apparatus comprising a lid. The lid is configured to close a mouth of a cavity formed in an elongate housing, in which the cavity is configured for housing a beacon configured to generate a magnetic dipole field. The lid comprises an inner layer disposable in face-to-face relationship with the cavity, an outer layer opposed to the inner layer and including an exterior surface; and an intermediate layer situated between the inner and outer layers and comprising electronic hardware.

DETAILED DESCRIPTION

Figure 1:
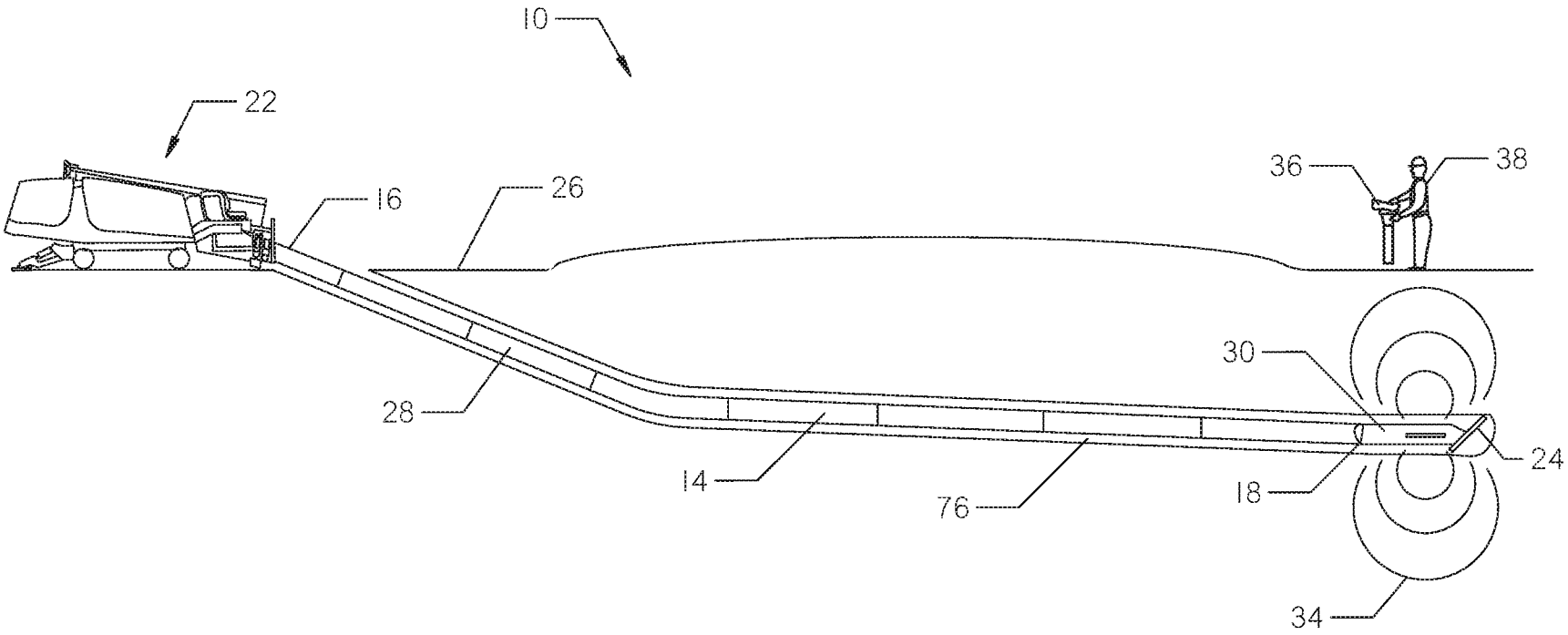
FIG. 1 is a diagrammatic illustration of a horizontal directional drilling system used to drill a borehole.

With reference to FIG. 1, a horizontal directional drilling system 10 is shown. The system 10 is used to create a borehole 12 under an above-ground obstacle, such as a roadway. The system 10 uses a drill string 14 having a first end 16 and a second end 18. The drill string 14 is attached to a drill rig 22 at its first end 16 and a drill bit 24 at its second end 18. The drill string 22 is supported on a ground surface 26 and is operated by a rig operator. The drill string 14 transmits thrust and rotation force from the drill rig 22 to the drill bit 24.

The drill string 14 is made up of a plurality of hollow pipe assemblies 28 arranged in an end-to-end relationship. In some embodiments, each pipe assembly is made of a single pipe section. In other embodiments, each pipe assembly is made of a two-pipe section—an inner pipe section disposed within an outer pipe section. The two-pipe sections, when joined together, make up an inner and outer drive train.

Continuing with FIG. 1, a downhole tool 30 is attached to the second end 18 of the drill string 14. The downhole tool 30 carries the drill bit 24 and houses a beacon 32, shown in FIG. 3. The beacon 32 is configured to emit a magnetic dipole signal 34. An above-ground tracker 36, operated by a tracker operator 38, is configured to detect and analyze the beacon signal 34 in order to determine the downhole position of the beacon 32. The beacon signal 34 includes information about the beacon 32 as well as the downhole conditions, such as the downhole temperature and fluid pressure. One embodiment of a tracker and its methods of use are described in U.S. Pat. No. 7,786,731 issued to Cole et al., the contents of which are incorporated herein by reference.

Figure 2:
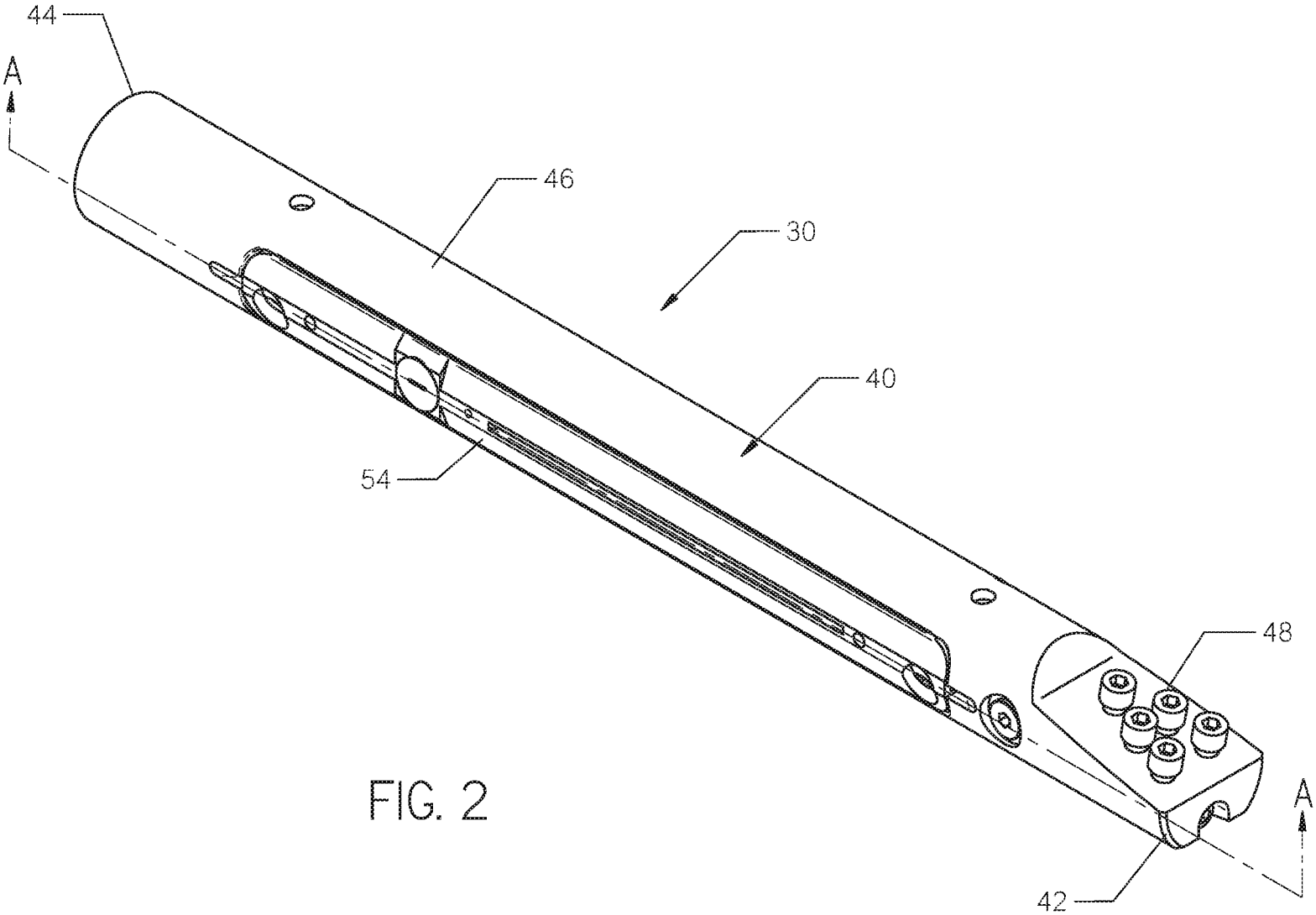
FIG. 2 is a front perspective view of a downhole tool used with the system shown in FIG. 1.

Turning to FIG. 2, the downhole tool 30 comprises an elongate housing 40 having opposed first and second ends 42 and 44 and an exterior surface 46. A plurality, of bit connectors 48 are supported on the first end 42 of the housing 40. The bit connectors 48 are configured for attaching the drill bit 24 to the downhole tool 30, as shown in FIG. 1. The second end 44 of the downhole tool 30 is configured to attach to the second end 18 of the drill string 14, as shown in FIG. 1.

Figure 3:
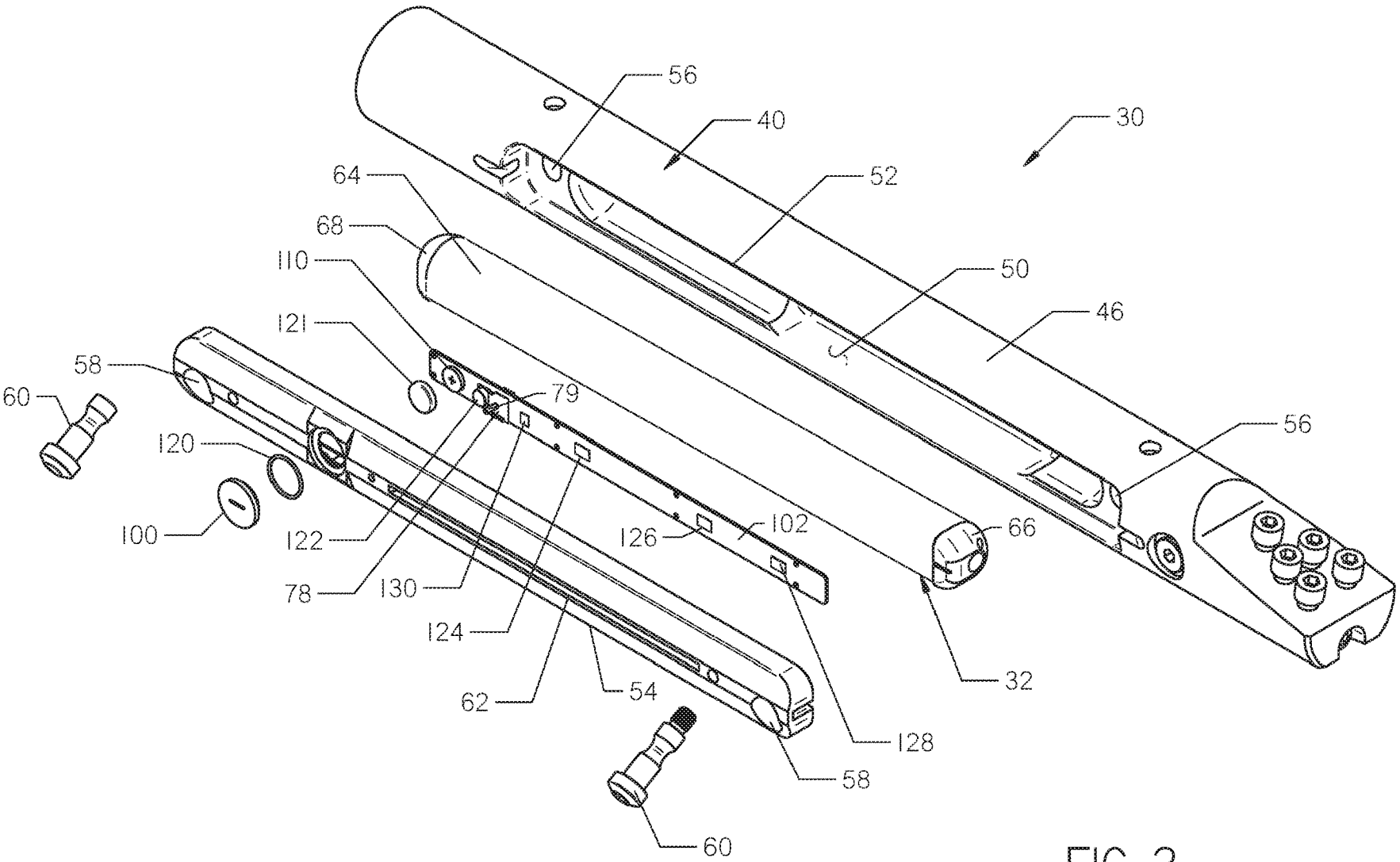
FIG. 3 is an exploded view of the downhole tool shown in FIG.
Figure 4:
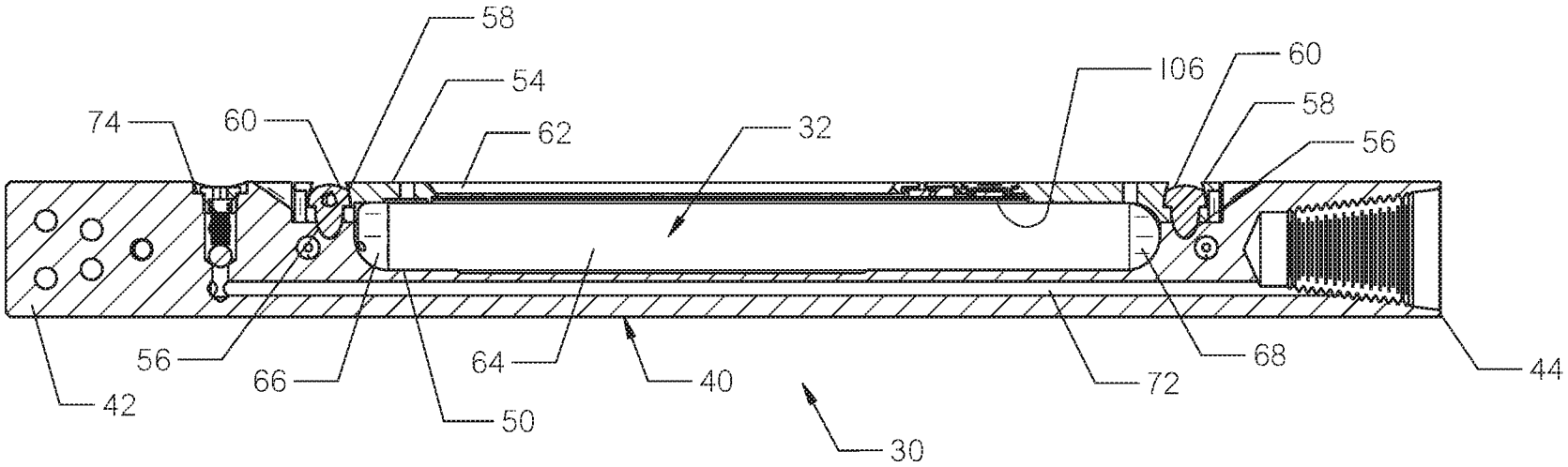
FIG. 4 is a cross-sectional view of the downhole tool shown in FIG. 2, taken along a plane that includes line A-A.

With reference to FIGS. 3 and 4, a cavity 50 is formed within the housing 40 for receiving the beacon 32. The cavity 50 extends parallel to a longitudinal axis of the housing 40 and has an open mouth 52 that joins the exterior surface 46 of the housing 40. The mouth 52 is covered by a lid 54, as shown in FIG. 2.

Figure 5:
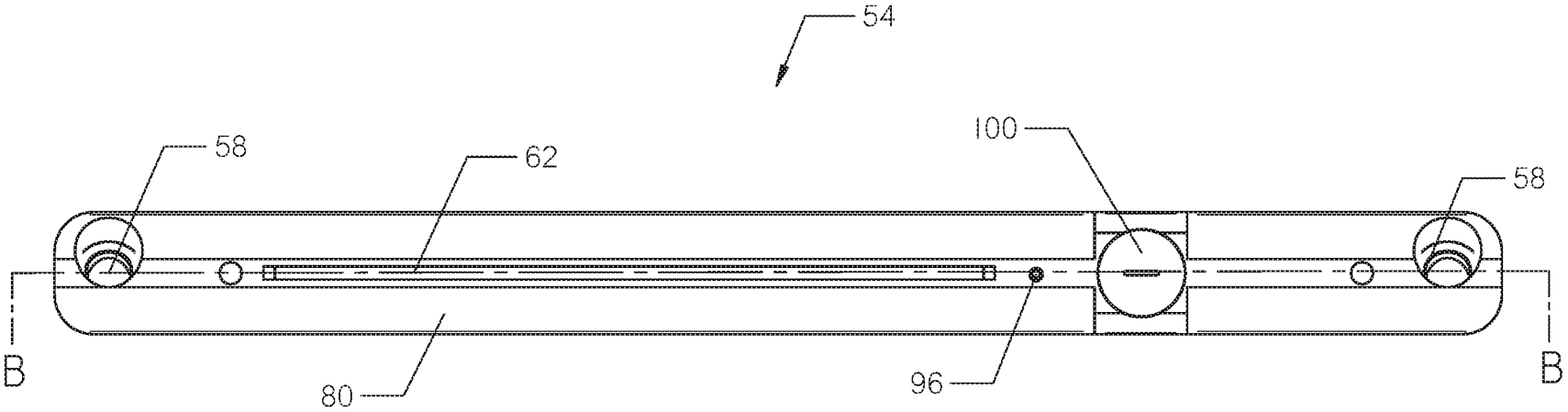
FIG. 5 is a top plan view of the lid attached to the downhole tool shown in FIG. 2.

A plurality of threaded openings 56 are formed in the housing 40 adjacent opposite ends of the cavity 50. The lid 54 is sized to cover the mouth 52 of the cavity 50 and the openings 56 formed in the housing 40. A plurality of openings 58 are also formed in the lid 54, as shown in FIG. 5. The openings 58 align with the openings 56 formed in the housing 40 when the lid 54 is positioned over the mouth 52 of the cavity 50, as shown in FIG. 4. A fastener 60, such as a bolt, is installed within each set of aligned openings 58 and 56 and is tightened in order to secure the lid 54 to the housing 40.

The housing 40 and the lid 54 are preferably made of a durable ferrous metal so as to not break during drilling operations. However, ferrous metals attenuate the beacon signal 34. To allow the beacon signal 34 to escape from the housing 40, a window 62 is formed in the lid 54, as also shown in FIG. 5. The window 62 is characterized by an elongate slot and is positioned directly above the beacon 32 when the lid 54 is attached to the housing 40. The window 62 provides an opening for the beacon signal 34 to pass through the housing 40 during operation. The window 62 may be filled with a non-ferrous material, such as plastic or silicon. One or more additional slots may be formed in the housing 40 to serve as additional antenna windows for the beacon signal 34.

Continuing with FIGS. 3 and 4, the beacon 32 comprises a magnetic dipole source or transmitter, a magnetic field sensor, a battery, a processor, and electrical circuitry positioned within an elongate housing 64. The housing 64 is a tube formed from a non-conductive material, such as plastic. The housing 64 is sealed closed by a first and second end cap 66 and 68. The first end cap 66 may include a keyed surface. The keyed surface is sized to correspond with a keyed surface formed in the walls of the tool housing 40 surrounding the cavity 50. Engagement of the first end cap 66 with the keyed surface helps hold the beacon 32 stationary within the housing 40.

With reference to FIGS. 1 and 4, during drilling operations, drilling fluid is pumped down the interior of the drill string 14 towards the drill bit 24. Drilling fluid is used to lubricate and cool the drill bit 24 during operation. A fluid flow path 72 is formed within the downhole tool's housing 40 in order to transfer the drilling fluid from the drill string 14 to the drill bit 24, as shown in FIG. 4. The drilling fluid exits the downhole tool 30 through one or more fluid ports 74 formed in the housing 40 adjacent the drill bit 24. Drilling fluid and cuttings return to the ground surface 26 through a borehole annulus 76, shown in FIG. 1.

As discussed above, the beacon 32 may transmit information about the downhole conditions to the tracker 36. One such condition is the fluid pressure within the borehole 12 around the downhole tool 30. During operation, fluid pressure typically remains constant within the borehole annulus 76 around the downhole tool 30. Thus, anomalies detected in the downhole fluid pressure may be indicative of a potential issue that may affect the drilling operation.

A sudden decrease in fluid pressure may indicate that drilling fluid has escaped from the borehole annulus 76 around the downhole tool 30. For example, if the drill bit 24 strikes an underground pipeline, fluid may escape into the open pipeline. Such scenario is known in the art as a "cross-bore". As another example, fluid may spurt from the ground surface as a result of the fluid pressure exceeding the pressure surrounding loose soil downhole. Such scenario is known inn the art as a "frac-out". Both scenarios normally must be remedied in order to successfully drill the desired borehole.

A sudden spike in fluid pressure may indicate that drilling fluid is accumulating downhole. For example, if something is blocking the borehole annulus 76, fluid may not return to the ground surface 26. Such scenario normally must be remedied in order to successfully drill the desired borehole.

One method of measuring the fluid pressure downhole is to place a pressure sensor within the beacon housing 64. When placed inside the beacon housing 64, the pressure sensor can be wired directly to the beacon's transmitter and utilize the same battery as the other electrical components within the beacon 32. However, space constraints within the beacon housing 64 make this arrangement undesirable. Such arrangement is also undesirable because the pressure sensor is only exposed to the fluid pressure within the tool housing 40. The fluid pressure within the tool housing 40 may not be indicative of the fluid pressure within the borehole annulus 76. Thus, it is preferable to place the pressure sensor in direct contact with the borehole annulus 76.

Figure 6:
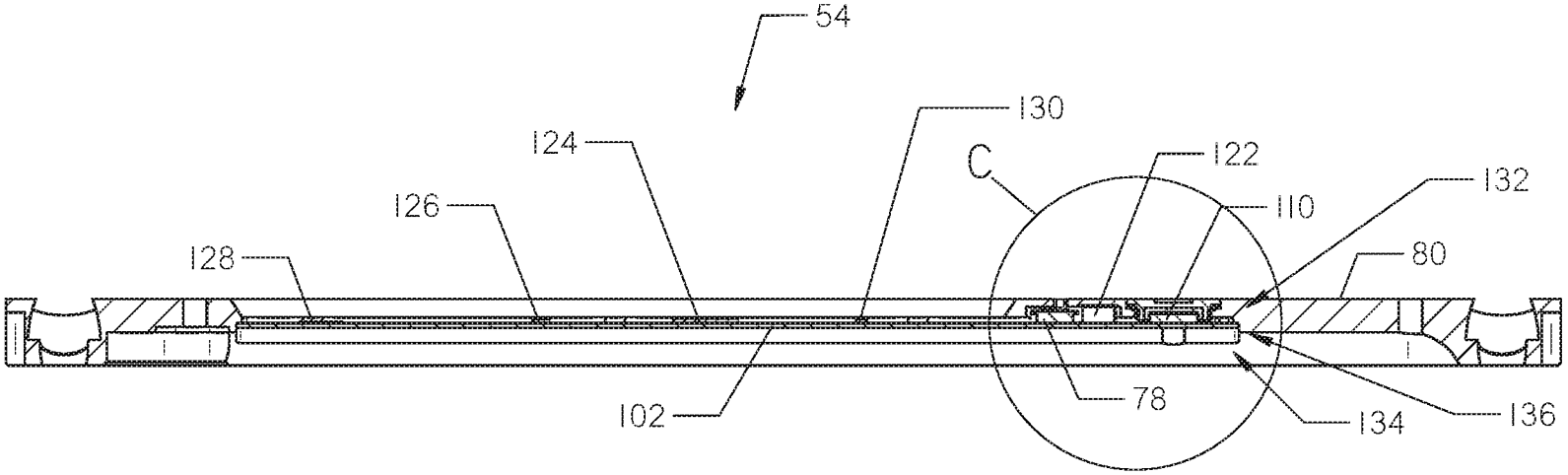
FIG. 6 is a cross-sectional view of the lid shown in FIG. 5, taken along line B-B.
Figure 7:
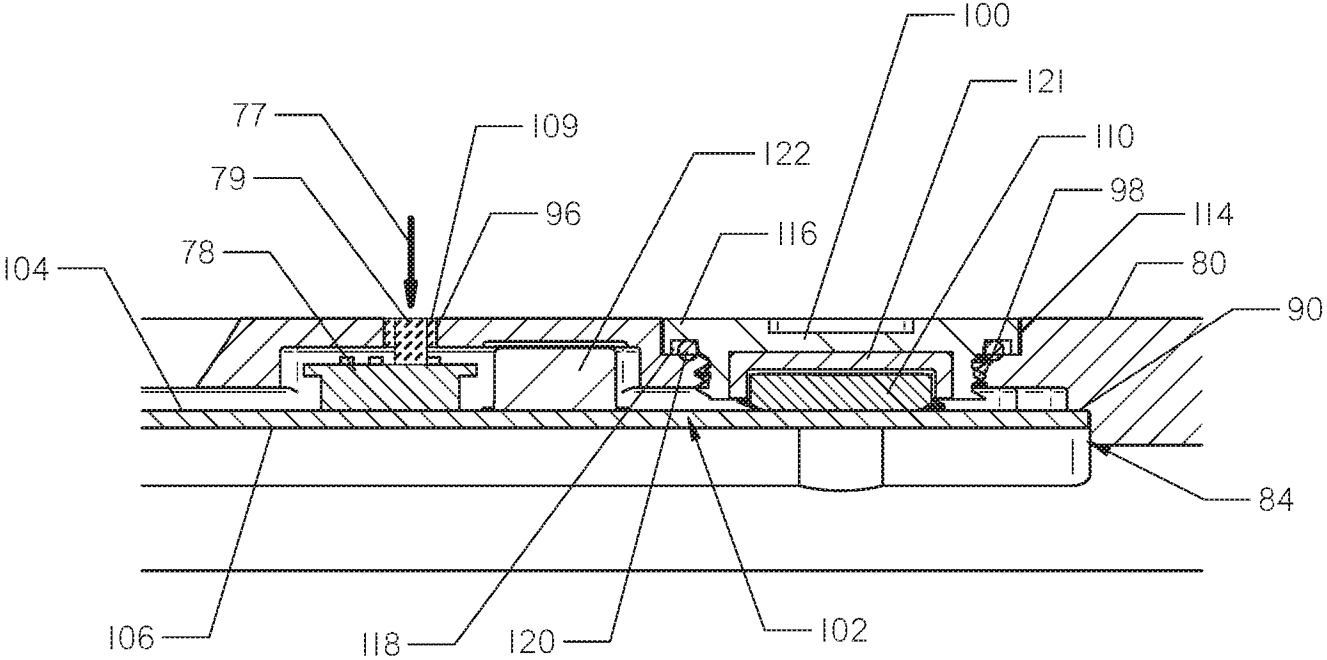
FIG. 7 is an enlarged view of area C from FIG. 6.

With reference to FIGS. 6 and 7, a pressure sensor 78 is installed within the lid 54 so that a portion of the sensor 78 is in direct contact with fluid contained within the borehole annulus 76. Thus, fluid pressure measurements recorded by the sensor 78 are indicative of the fluid pressure within the borehole annulus 76.

Figure 8:
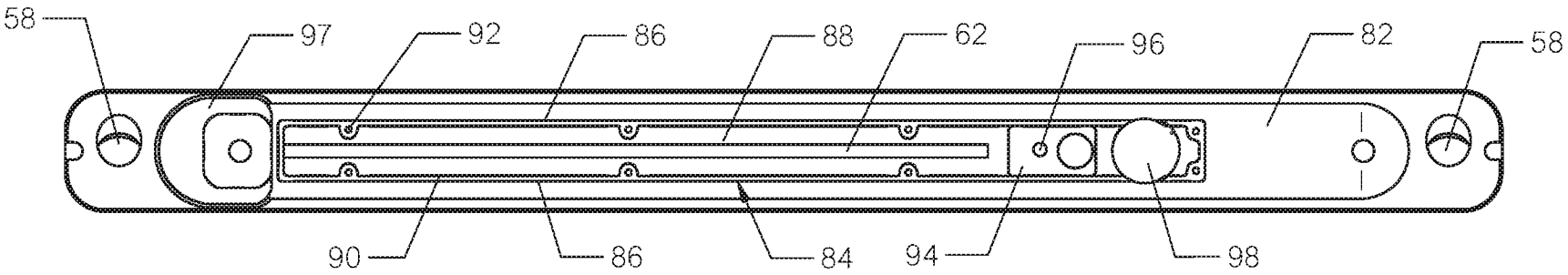
FIG. 8 is a bottom plan view of the lid shown in FIG. 5, but the circuit board and electrical components shown in FIG. 6 have been removed.
Figure 9:
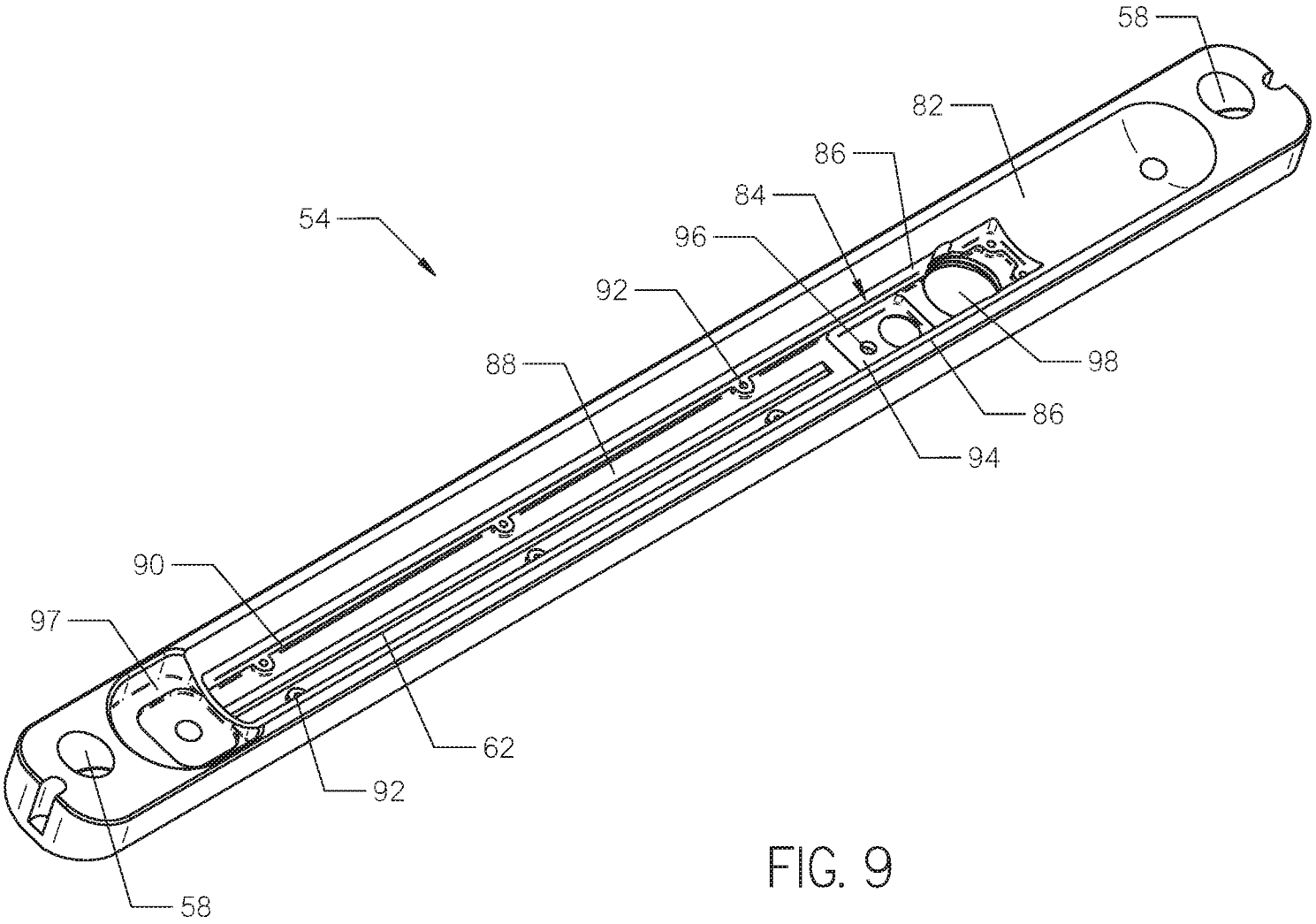
FIG. 9 is a bottom perspective view of the lid shown in FIG. 8.

With reference to FIGS. 5, 8, and 9, the lid 54 includes an exterior surface 80, shown in FIG. 5, and an opposed interior surface 82, shown in FIGS. 8 and 9. A groove 84 is formed in the interior surface 82 and extends along a longitudinal axis of the lid 54. The groove 84 is characterized by two side walls 86 joined by a base 88. The window 62 interconnects the exterior surface 80 of the lid 54 and the base 88 of the groove 84. A recessed ledge 90 is formed along each side wall 86 and includes a plurality of threaded holes 92.

Continuing with FIGS. 8 and 9, a notch 94 is formed in the base 88 of the groove 84. A port 96 is formed within the notch 94 and interconnects the exterior surface 80 of the lid 54 and the base 88 of the groove 84. As will be discussed later herein, the notch 94 is sized so that at least a portion of the pressure sensor 78 may be positioned within the notch 94 and directly below the port 96, as shown in FIG. 7. A threaded opening 98 is also formed in the base 88 of the groove 84, adjacent the notch 94. The threaded opening 98 is configured for receiving a battery cap 100, as shown in FIGS. 5 and 7. A notch 97 may also be formed in the interior surface 82 of the lid 54 between the groove 84 and one of the openings 58. The notch 97 may serve as a keyed surface that corresponds with a keyed surface formed on the beacon's first end cap 66. Engagement of the keyed surfaces helps to hold the beacon 32 stationary during operation.

Figure 10:
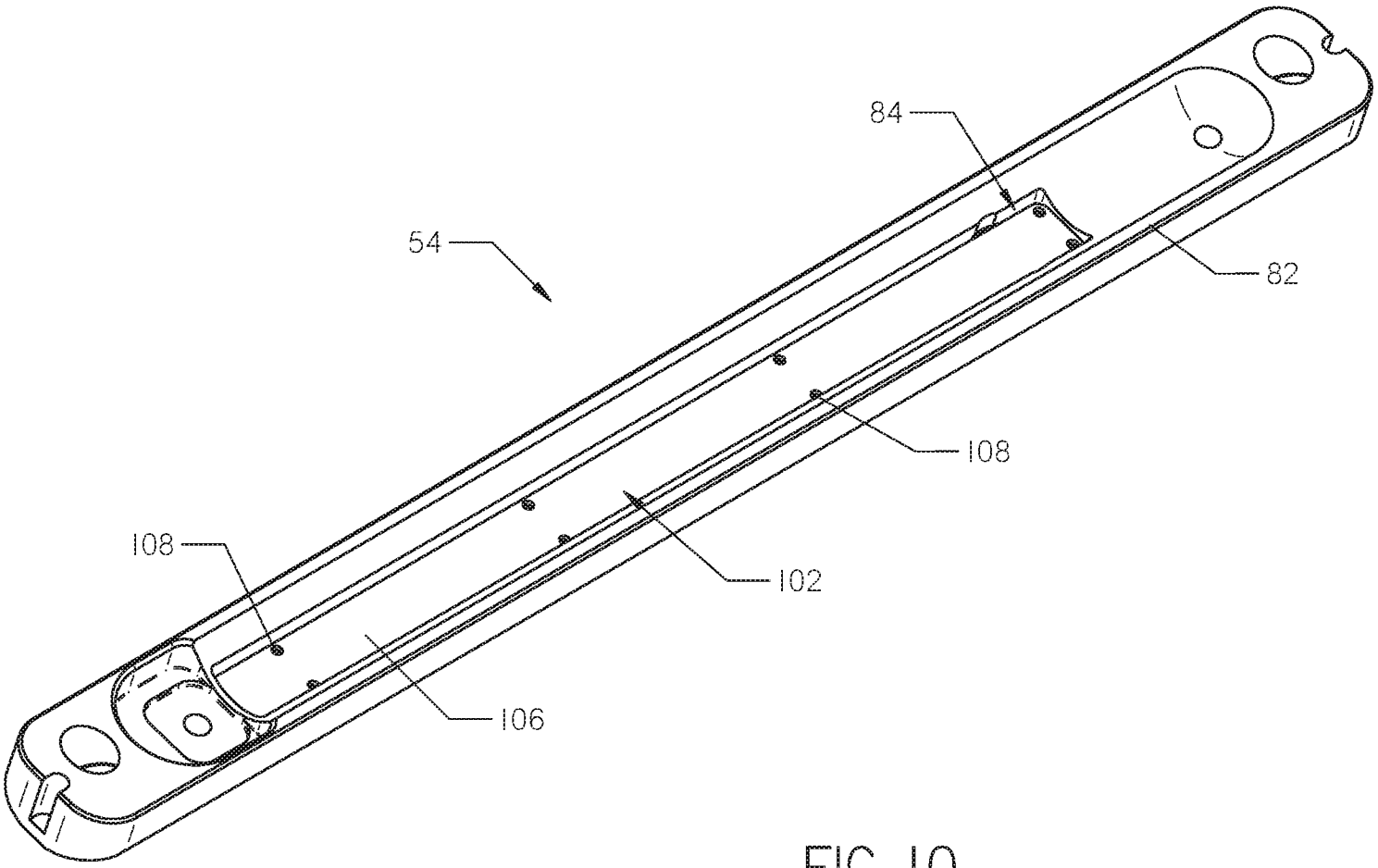
FIG. 10 is the bottom perspective view of the lid shown in FIG. 9, but the circuit board and electrical components have been installed.

Turning to FIGS. 3, 7 and 10, a board 102 is installed within the groove 84. The board 102 shown in the figures is a circuit board. In alternative embodiments, the board may be any form of a support structure. The board 102 has a top surface and an opposed bottom surface 104 and 106, as shown in FIG. 7. The board 102 is installed within the groove 84 such that its top surface 104 engages with the recessed ledges 90 formed in the side walls 86, as shown in FIG. 10.

A plurality of holes 108 are formed around the periphery of the board 102. The holes 108 align with the threaded holes 92 when the board 102 is installed within the groove 84. A plurality of fasteners, such as screws, may be registered within each of the aligned holes 108 and 92 and tightened in order to secure the board 102 to the lid 54. When the lid 54 is installed on the housing 40, the bottom surface 106 of the board 102 is in a face-to-face relationship with the beacon 32, as shown in FIG. 4.

With reference to FIGS. 6 and 7, the board 102 supports and protects electronic hardware installed within the lid 54. The hardware is positioned between the top surface 104 of the board 102 and the base 88 of the groove 84 and comprises, in part, the pressure sensor 78.

The pressure sensor 78 is supported on the board 102 and projects at least partially into the notch 94. A projecting portion 79 of the pressure sensor 78 projects into the port 96. The port 96, with the installed pressure sensor 78, is filled with a potting compound 109 so as to encase the projecting portion 79 of the sensor 78 within the port 96. During operation, the potting compound 108 is exposed to the borehole annulus 76. Fluid pressure exerted on the potting compound 108, as shown by arrow 77 in FIG. 7, is communicable with the pressure sensor 78.

While not shown, potting compound may also fill the entire cavity between the board 102 and the interior surface 82 of the lid 54. The potting compound helps to stabilize and protect the electronic hardware during operation.

The electronic hardware further comprises a battery 110. The battery 110 is supported on the board 102 and powers the pressure sensor 78. The battery 110 is positioned below the threaded opening 98 and is covered by the battery cap 100. The battery cap 100 allows access to the battery no without having to remove the lid 54 from the housing 40, allowing the battery no to be easily replaced, if needed.

Continuing with FIG. 7, the battery cap 100 has external threads configured for mating with the threaded opening 98.

The threaded opening 98 opens into a counterbore 114 adjacent the exterior surface 80 of the lid 54. A flange 116 is formed around the battery cap 100 that is sized to fit within the counterbore 114. A groove 118 is formed in the bottom surface of the flange 116 for housing a seal 120, also shown in FIG. 3. The seal 120 prevents fluid from leaking around the battery cap 100 and towards the battery 13.

Continuing with FIG. 7, an insulator 121, also shown in FIG. 3, is installed within the interior of the battery cap 100. The insulator 121 isolates the battery from any potting compound that may surround the other components making up the electronic hardware. In alternative embodiments, a seal may be used in place of the insulator 121 to isolate the battery no from the potting compound, as shown for example in FIG. 13. A circuit board may also be installed within the interior of the battery cap 100. The circuit board may be engaged with the battery 110 via a spring, as shown for example in FIG. 13.

Continuing with FIGS. 3 and 7, the electronic hardware may also comprise a storage capacitor 122 connected to both the battery no and the pressure sensor 78. The storage capacitor 122 may be supported on the board 102 between the sensor 78 and battery no and project at least partially into the notch 94, as shown in FIG. 7. The storage capacitor 122 stores energy from the battery no and powers the pressure sensor 78 with the stored energy. During operation, vibrations within the downhole tool 30 may cause small interruptions in the battery's current flow and therefore cut off power to the pressure sensor 78. Powering the pressure sensor 78 with the storage capacitor 122 rather than directly from the battery 110 prevents any potential brief interruptions in power.

With reference to FIGS. 3 and 6, the electronic hardware further comprises a microprocessor 124, a packet radio chip 126, radio antenna 128, and beacon signal detector 130. Each of the electronic components is supported on the board 102 and powered by the battery 110 or storage capacitor 122.

In operation, the pressure sensor 78 measures and records the fluid pressure applied to the sensor 78 at the port 96. The recorded measurement is sent to the microprocessor 124. The microprocessor 124 reads the recorded measurement and transmits the pressure reading to the packet radio chip 126. The packet radio chip 126 uses the radio antenna 128 to wirelessly transmit the pressure reading to the beacon 32. The beacon 32 subsequently transmits the pressure reading via the beacon signal 34 to the above-ground tracker 36, as shown in FIG. 1. The tracker 36 displays the pressure reading measured by the pressure sensor 78 for the tracker operator 38.

During operation, the pressure sensor 78 is only awake long enough to record a measured fluid pressure and transmit the recording to the microprocessor 124. Once the recording has been sent, the pressure sensor 78 goes into sleep mode in order to conserve battery power. The pressure sensor 78 may be set to awake and record a measured fluid pressure at desired intervals. For example, the pressure sensor 78 may awake every four seconds.

The pressure sensor 78 will continue to record a measured fluid pressure as long as the beacon 32 is transmitting the beacon signal 34. The beacon signal detector 130 detects the presence of the beacon signal 34. The beacon 32 may go into sleep mode at times, and therefore no longer transmit the beacon signal 34. If the beacon signal detector 130 does not detect the beacon signal 34, the detector 130 will notify the microprocessor 124. The microprocessor 124 will in turn direct the pressure sensor 78 to go into sleep mode until the beacon signal 34 is again detected by the beacon signal detector 130. Once the microprocessor 124 is notified by the beacon signal detector 130 that the beacon signal 34 is again being detected, the microprocessor 124 will wake up the pressure sensor 78. The beacon signal detector 130 continues to operate in low power mode to awaken the pressure sensor 78 via the microprocessor 124, as needed.

Figure 11:
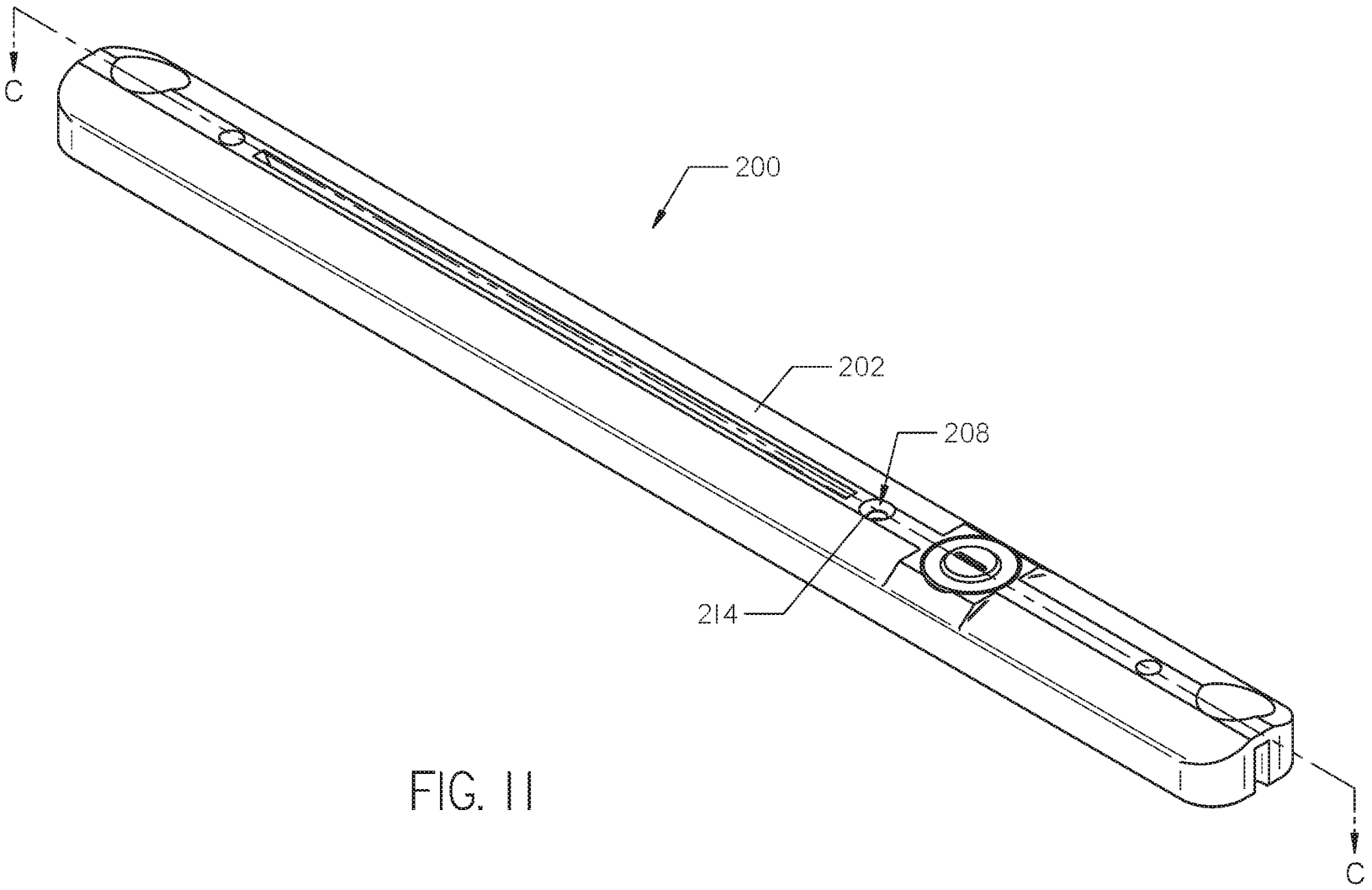
FIG. 11 is a perspective view of another embodiment of a lid for use with the downhole tool shown in FIG. 2.
Figure 12:
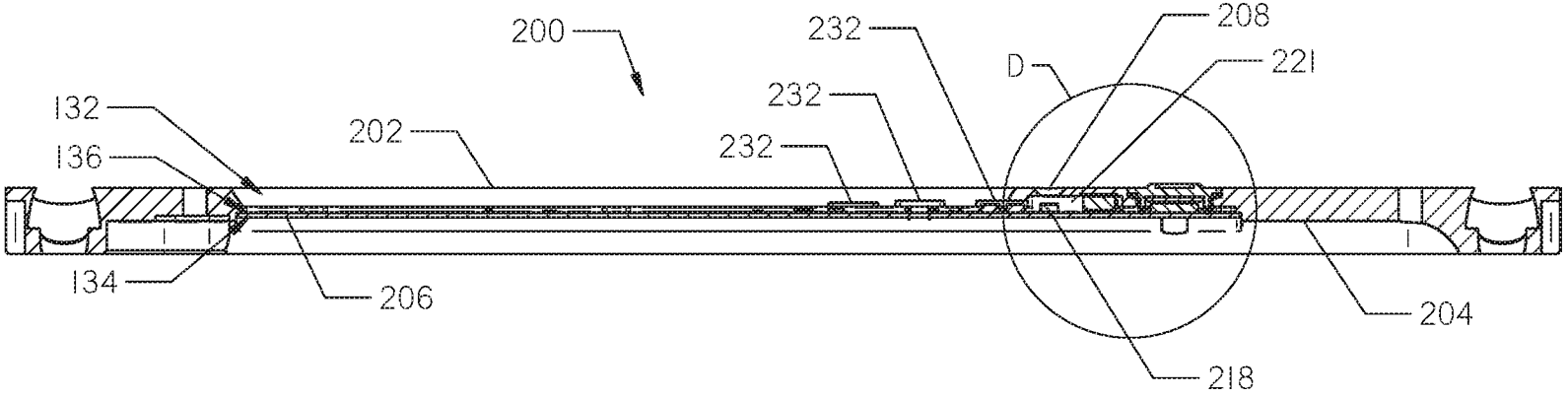
FIG. 12 is a cross-sectional view of the lid shown in FIG. 11, taken along line C-C.
Figure 13:
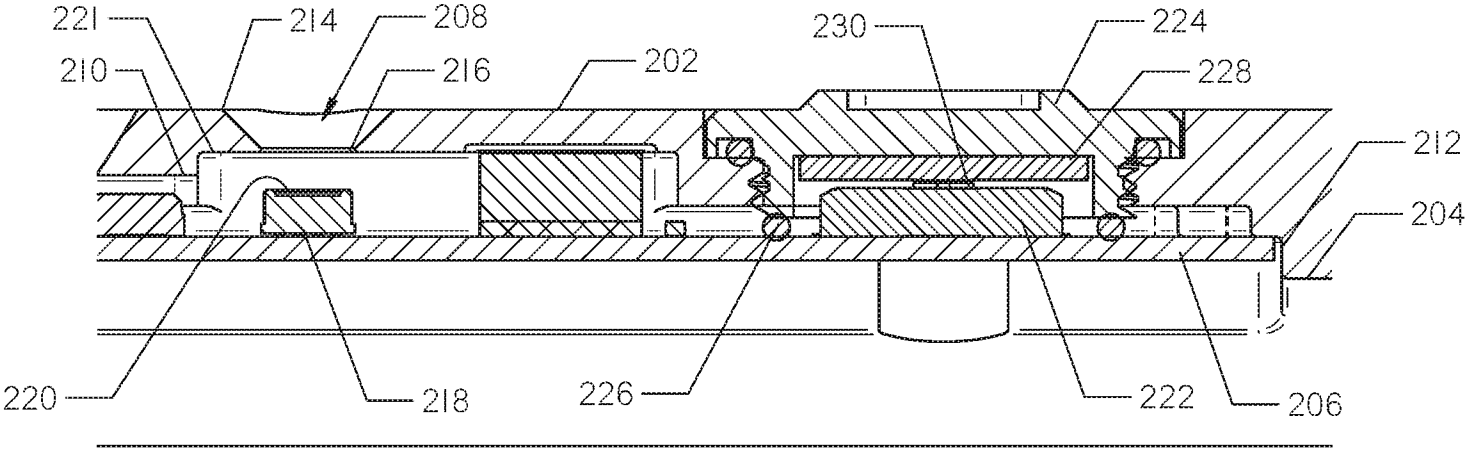
FIG. 13 is an enlarged view of area D from FIG. 13.

Turning to FIGS. 11-13, another embodiment of a lid 200 is shown. The lid 200 includes an exterior surface 202 and an opposed interior surface 204. A board 206 is installed within the lid 200 and supports electronic hardware. The lid 200 is substantially identical to the lid 54, with a few exceptions that are described below. Likewise, the board 206 and electronic hardware are substantially identical to those used with the lid 54, with a few exceptions that are described below.

With reference to FIGS. 11 and 13, a port 208 is formed in the lid 200. The port 208 interconnects the exterior surface 202 of the lid 200 and a base 210 of a groove 212 formed in the interior surface 204 of the lid 200, as shown in FIG. 13. The port 208 tapers inwardly between its exterior and interior openings 214 and 216, such that the port 208 has a bowl shape.

Continuing with FIG. 13, the electronic hardware used with the lid 200 includes another embodiment of a pressure sensor 218. The pressure sensor 218 does not include a projecting portion, like the pressure sensor 78. Instead, a top surface 220 of the pressure sensor 218 is positioned in close proximity to the interior opening 216 of the port 208. For example, the interior opening 216 and the top surface 220 may be spaced apart by approximately 0.10 inches. Fluid pressure communicates with the top surface 220 of the pressure sensor 218.

A notch 221 is formed in the base 210 of the groove 212 above the pressure sensor 218 in FIG. 13. In alternative embodiments, the notch 221 may be removed. Such construction may help to decrease the distance between the interior opening 216 of the port 208 and the top surface 220 of the pressure sensor 218, as needed.

With reference to FIGS. 12 and 13, potting compound may fill the cavity between the interior surface 204 of the lid 200 and the board 206. The potting compound may fill a portion of the port 208 adjacent its interior-opening 216, but leave the remainder of the port 208 open. Thus, fluid pressure communicates with the top surface 220 of the pressure sensor 218 via the potting compound. In operation, the bowl shape of the port 208 helps funnel fluid towards the top surface 220 of the pressure sensor 218.

Continuing with FIG. 13, a battery 222 and a battery cap 224 are installed within the lid 200. The battery 222 and the battery cap 224 are identical to the battery 100 and battery cap 110 installed within the lid 54, with a few exceptions. The battery cap 224 does not include an insulator, like the insulator 121. Instead, a second seal 226 is positioned between a bottom surface of the battery cap 224 and the board 206. The second seal 226 protects the battery 222 from the potting compound surrounding the other components making up the electronic hardware.

A circuit board 228 is installed within the interior of the battery cap 224 and is positioned above the battery 222. A spring 230 extends between the battery 222 and the circuit board 228. The circuit board 228 and spring 230 help transfer power from the battery 222 to the other components making up the electronic hardware. As discussed above, the circuit board 228 and spring 230 may also be installed within the battery cap 110.

With reference to FIG. 12, a series of notches 232 may be formed within the base 210 of the groove 212, in addition to the notch 221. The notches 232 provide extra space between the electronic hardware and the base 210 of the groove 212. The lid 54 may include similar notches above the electronic hardware, in addition to the notch 94.

With reference to FIGS. 6 and 12, the lids 54 and 200 may each be construed as having layers. The exterior surface 80 or 202 of the lid 54 or 200 may be considered an outer layer 132. The board 102 or 206 may be considered an inner layer 134, and the electronic hardware may be considered an intermediate layer 136.

The lids 54 and 200 may be sized and shaped, as needed, to fit on other embodiments of downhole tools known in the art. The lids 54 and 200 are configured so that each may easily replace already existing lids known in the art and therefore be installed onto already existing downhole tools.

Changes may be made in the construction, operation and arrangement of the various parts, elements, steps and procedures described herein without departing from the spirit and scope of the invention as described in the following claims.

The invention claimed is:

1. A downhole tool, comprising:
a beacon configured to generate a magnetic dipole field;
an elongate housing having an exterior surface within which a cavity is formed, the cavity receiving the beacon and having an open mouth that joins the exterior surface of the housing; and
a lid configured to close the mouth of the cavity, and comprising:
an inner layer disposable in a face-to-face relationship to the beacon;
an outer layer opposed to the inner layer and including an exterior surface and an interior surface; in which a groove is formed within the interior surface; and
an intermediate layer situated between the inner and outer layers and comprising electronic hardware; in which at least a portion of the intermediate layer is positioned within the groove.

2. The downhole tool of claim 1 in which the electronic hardware comprises a pressure sensor, and in which a pressure port formed in the outer layer establishes communication between the exterior surface of the lid and the pressure sensor.

3. The downhole tool of claim 2 in which the electronic hardware further comprises a microprocessor.

4. The downhole tool of claim 2 in which the electronic hardware further comprises a battery.

5. The downhole tool of claim 2 in which the electronic hardware further comprises an antenna configured to receive data collected by the pressure sensor and configured to communicate with the beacon.

6. A system, comprising:
an elongate drill string having a first end and a second end;
a horizontal directional drilling machine operatively engaged to the first end of the drill string; and
the downhole tool of claim 2 attached to the second end of the drill string.

7. The system of claim 6, in which the downhole tool is positioned underground and within a horizontal borehole, the system further comprising:
a pressurized fluid contained within the borehole and exposed to at least a portion of the pressure sensor.

8. The downhole tool of claim 1 in which the inner layer comprises a circuit board and the electronic hardware of the intermediate layer is supported on the circuit board.

9. The downhole tool of claim 8 in which the electronic hardware comprises:
a pressure sensor;
a microprocessor;
an antenna; and
a beacon signal detector.

10. The downhole tool of claim 9 in which the electronic hardware further comprises a packet radio chip.

11. The downhole tool of claim 1 in which the inner layer comprises a support structure, and in which the intermediate layer is supported on the support structure.

12. The downhole tool of claim 1 in which the outer layer comprises a removable cap.

13. The downhole tool of claim 1, further comprising:
a drill bit attached to a first end of the housing.

14. An apparatus, comprising:
a lid configured to close a mouth of a cavity formed in an elongate housing, the cavity configured for housing a beacon configured to generate a magnetic dipole field, the lid comprising:
an inner layer disposable in face-to-face relationship with the cavity;
an outer layer opposed to the inner layer and including an exterior surface;
an intermediate layer situated between the inner and outer layers and comprising electronic hardware; in which the electronic hardware comprises a pressure sensor;
an elongate window formed in the outer layer, the window configured to allow the magnetic dipole field to exit the housing; and
a pressure port formed in the outer layer and spaced from the window; in which the pressure port establishes communication between the exterior surface of the outer layer and the pressure sensor.

15. The apparatus of claim 14 in which the inner layer comprises a circuit board and the electronic hardware of the intermediate layer is supported on the circuit board.

16. The apparatus of claim 14 in which the electronic hardware further comprises:
a microprocessor;
an antenna; and
a beacon signal detector.

17. The apparatus of claim 14 in which the electronic hardware further comprises a battery.

18. A downhole tool, comprising:
a beacon configured to generate a magnetic dipole field;
an elongate housing having an exterior surface within which a cavity is formed, the cavity receiving the beacon and having an open mouth that joins the exterior surface of the housing; and
the apparatus of claim 14 positioned over the mouth.

19. An apparatus, comprising:
a lid configured to close a mouth of a cavity formed in an elongate housing, the cavity configured for housing a beacon configured to generate a magnetic dipole field, the lid comprising:
an inner layer disposable in face-to-face relationship with the cavity;
an outer layer opposed to the inner layer and including an exterior surface and an opposed interior surface;
an intermediate layer situated between the inner and outer layers and comprising electronic hardware; in which the electronic hardware comprises a pressure sensor;
a pressure port formed in the outer layer and interconnecting the exterior surface and the interior surface of the outer layer; in which the pressure port establishes communication between the exterior surface of the outer layer and the pressure sensor; and a material disposed within the pressure port such that the interior surface of the outer layer is sealed from the exterior surface of the outer layer.

20. The apparatus of claim 19, in which the pressure port is aligned with the pressure sensor.

21. The apparatus of claim 19, in which at least a portion of the pressure sensor projects into at least a portion of the pressure port.

22. The apparatus of claim 19, in which the material comprises a potting compound.

* * * * *